United States Patent [19]

Meier

[11] 4,224,887

[45] Sep. 30, 1980

[54] SEWING MACHINE WITH FABRIC-SUPPORTING ARM AND ADD-ON TABLE

[75] Inventor: Willi Meier, Karlsruhe-Durlach, Fed. Rep. of Germany

[73] Assignee: Dorina Nähmaschinen GmbH, Fed. Rep. of Germany

[21] Appl. No.: 6,196

[22] Filed: Jan. 24, 1979

[30] Foreign Application Priority Data

Jan. 26, 1978 [DE] Fed. Rep. of Germany ... 7802259[U]

[51] Int. Cl.[2] ..... A47B 29/00

[52] U.S. Cl. ..... 112/260; 248/289.1

[58] Field of Search ..... 112/260, 13, 217.1; 403/157, 158; 248/289 R, 290; 108/26; 312/208, 251

[56] References Cited

U.S. PATENT DOCUMENTS

| | | | |
|---|---|---|---|
| 1,109,989 | 9/1914 | Hohmann | 112/260 |
| 2,161,528 | 6/1939 | Mueller | 112/260 |
| 3,255,719 | 6/1966 | Klavins | 108/26 |

FOREIGN PATENT DOCUMENTS

| | | | |
|---|---|---|---|
| 125054 | 5/1945 | Australia | 112/260 |
| 482298 | 7/1953 | Italy | 112/260 |

*Primary Examiner*—Werner H. Schroeder
*Assistant Examiner*—Andrew M. Falik
*Attorney, Agent, or Firm*—McGlew and Tuttle

[57] ABSTRACT

A sewing machine includes a baseplate with a pedestal thereon having an upstanding column on the pedestal supporting an upper arm carrying the drive for a reciprocating sewing needle. A fabric-supporting arm extends outwardly from the pedestal and overlies one side of the baseplate below the upper arm and carries the thread-engagement mechanism, for example. The baseplate advantageously carries a bearing bushing for pivotally supporting an add-on table so that a pivot belt of the table may be pivoted about a vertical axis which is in substantial alignment with the rear wall of the supporting arm. The add-on table includes a first portion which extends at right angles to a second portion thereof and when the first portion is pivoted alongside the front end of the fabric-supporting arm, the second portion will be disposed along a side face of the supporting arm. The height of the table and the dimensions of the pivot bolt are such that the add-on table provides a surface which forms a continuation of the top surface of the supporting arm.

4 Claims, 2 Drawing Figures

SEWING MACHINE WITH FABRIC-SUPPORTING ARM AND ADD-ON TABLE

FIELD AND BACKGROUND OF THE INVENTION

This invention relates to the construction of sewing machines in general and, in particular, to a new and useful sewing machine construction which includes a pedestal which is mounted on a baseplate and carries a supporting arm which overlies a portion of the baseplate and including an add-on table which is pivotally mounted about a vertical axis which is substantially in alignment with the rear edge of the supporting arm.

DESCRIPTION OF THE PRIOR ART

In a known sewing machine of this type, an add-on table is connected through a hinge mounted to its front edge to a vertical stem linked to the front side of the baseplate. When the add-on table is not being used, the stem is flipped towards the front, and the table then rests on the stem or on the baseplate. The disadvantage of this arrangement is that when the table is not in use, additional space is required for the table in the direction towards the operator whose activity is thus hindered. Moreover, the flipped-down add-on table blocks a part of the space below the fabric-supporting arm.

SUMMARY OF THE INVENTION

The present invention provides an improved arrangement for an add-on table for sewing machines. This is accomplished in that the add-on table is pivotable about a vertical axis essentially tangent to the lateral continuation of the rear contour of the fabric-supporting arm.

The add-on table is advantageously removable from the baseplate in that it is pivotable about a bearing recessed in the baseplate, in which bearing, a bearing pin of a bolt which supports the ad-on table is insertable. In order to utilize the space between the fabric-supporting arm of the machine, the add-on table top and the baseplate, the part of the add-on table disposed in front of the fabric-supporting arm is designed as a container and is closed by a cover extending flush with the top of the fabric-supporting arm.

Accordingly, an object of the present invention is to provide a sewing machine which includes a base-plate, a base pedestal mounted on the baseplate, and a fabric-supporting arm extending outwardly from the pedastal and overlying one side of the baseplate, the improvement, which comprises an add-on table and pivotal mounting means pivotally supporting the add-on table alongside and spaced from the fabric-supporting arm for pivotal movement about a vertical axis substantially in alignment with the rear edge of the support arm, the baseplate advantageously comprising a two-part structure of a substantially L-shaped configuration.

A further object of the present invention is to provide a sewing machine with fabric-supporting arm and add-on table which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

DESCRIPTION OF THE PREFERRED EMBODIMENT

Figure 1:
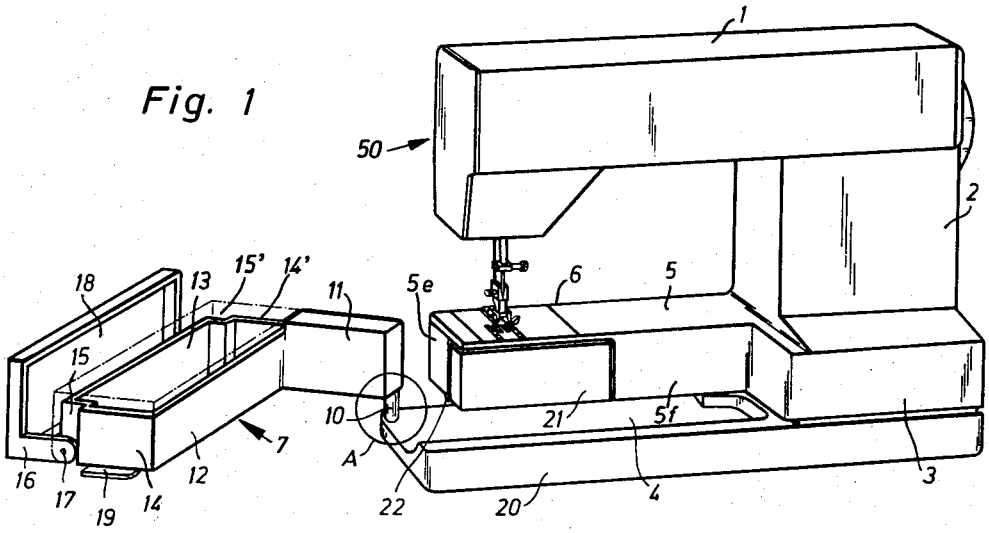
FIG. 1 is a front, top perspective view of a sewing machine having an add-on table constructed in accordance with the invention.
Figure 2:
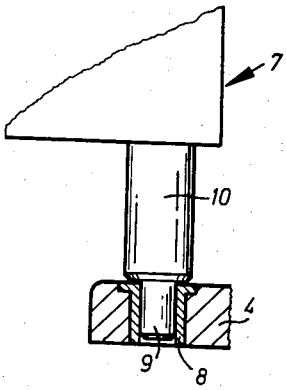
FIG. 2 is a partial sectional and partial elevational view indicating the mounting of the add-on table on the baseplate.

Referring to the drawing in particular, the invention embodied therein, comprises, an improvement in the construction of a sewing machine, generally designated 50, so as to provide an add-on table 7 for use therewith which does not interfere with the operation of the sewing machine and which provides a novel arrangement for the use and orientation of the add-on table and for its removal from the working area without difficulty.

The sewing machine 50, shown in FIG. 1, has an upper arm 1 connected through a column 2 to a pedestal 3. The pedestal 3 is supported by a baseplate 4. The sewing machine is equipped with a fabric-supporting arm 5 which is shifted to the back in relation to the center line of the pedestal 3 and is essentially of a rectangular section. The lower stitch-forming tools, in particular, the gripper of the sewing machine (not shown), are housed in the arm 5.

The fabric-supporting arm 5 is limited by a rear wall 6, through whose lateral continuation extends a vertical pivot axis 10 of an add-on table 7. For this purpose, a bearing bushing 8 is recessed in the baseplate 4. A baseplate pin 9 is guided therein and forms an extension of a bolt 10 which is rigidly joined to the add-on table 7. The length of bolt 10 is such that the top of the add-on table 7 is flush with the top of the fabric-supporting arm 5.

The add-on table 7 is designed as an L-shaped box comprising two parts 11 and 12. The height of the two parts 11 and 12 is harmonized with the height of the fabric-supporting arm 5. The add-on table 7 can be pivoted from its swung-out position, shown in FIG. 1, about the bolt 10 into a position in which the part 11 rests laterally against an end wall **5*e* of fabric-supporting arm 5, while the part 12 fills the free space in front of the wall 5*f* of the fabric-supporting arm 5. The part 12 designed as a container 13 which is capable of accommodating accessories. The end faces 14, 14' of the container 13 are provided with a recess 15, 15', each of which are entered by arms 16 hinged to the lower ends of the part 12 by means of pivot pins 17 and connected to a cover 18 for the container 13**.

In its condition swung against the fabric-supporting arm 5 of the machine (not shown), the top of the add-on table 7 forms a plane surface with the top of the fabric-supporting arm 5, with an arm 9 projecting from the underside of the one face 14 positioning itself under the pedestal 3 and behind a spring lock, which has not been shown.

The front edge of the baseplate 4 is pulled up to form a front surface 20 which reaches to the underside of the swung-in add-on table 7 so as to give a closed appearance from the front without noticeably restricting the free space opposite the fabric-supporting arm 5 when the add-on table 7 is swung out.

The stitch-forming tools housed in the fabric-supporting arm 5 are accessible through a flap 21 which is pivotable about a hinge pin 22 extending parallel to the longitudinal axis of the fabric-supporting arm 5 on the underside of arm 5. The front side of the flap 21 rests on baseplate 4 when flipped down. Therefore, the flap 21 may stay open in the swung-in condition (not shown) of the add-on table 7.

While a specific embodiment of the invention has been shown and described in detail to illustrate the application of the principles of the invention, it will be understood that the invention may be embodied otherwise without departing from such principles.

What is claimed is:

1. In a sewing machine, including a baseplate, a base pedestal mounted on said baseplate and a fabric-supporting arm extending outwardly from said pedestal and overlying at least one side of the baseplate, the improvement comprising, an add-on table of substantially L-shaped configuration having a first part which is alignable with an edge of the arm and a second part extending at substantially right angles to said first part which is alignable with a side of the arm, and pivotable mounting means pivotally supporting said add-on table alongside and spaced from the fabric-supporting arm for pivotal movement about a vertical axis which is substantially in alignment with a rear edge of the supporting arm.

2. In a sewing machine, the improvement claimed in claim 1, wherein said baseplate includes a bushing therein, said pivotal mounting means including a bolt connected to one edge of said add-on table and having a pivot pin extension rotatably supported in said bearing bushing.

3. In a sewing machine, the improvement claimed in claim 2, wherein the tops of said first and second parts are substantially flush with the top of the supporting arm, said pivot pin of said first part comprising a bolt portion and a pin portion connected to the end of said bolt portion being of a smaller diameter than said bolt portion, said baseplate having a bushing into which said pin portion is engaged, the portion of said bolt which is larger than said pin portion overlying said base-plate and being supported thereon to orient the tops of said first and second parts flush with the top of the fabric-supporting arm.

4. In a sewing machine, including a baseplate, a base pedestal mounted on said baseplate and a fabric-supporting arm extending outwardly from said pedestal and overlying at least one side of the baseplate, the improvement comprising, an add-on-table, and pivotal mounting means pivotally supporting said add-on table alongside and spaced from the fabric-supporting arm for pivotal movement about a vertical axis which is substantially in alignment with a rear edge of the supporting arm, said add-on table including a first part having a pivot pin comprising said pivotal mounting means and a second part extending substantially at right angles to said first part, said second part comprising a container and a cover pivotally mounted to said second part and closing said container.

* * * * *